US008902138B2

(12) United States Patent
Kim

(10) Patent No.: US 8,902,138 B2
(45) Date of Patent: Dec. 2, 2014

(54) ORGANIC LIGHT EMITTING DIODE DISPLAY DEVICE AND METHOD OF DRIVING THE SAME

(71) Applicant: LG Display Co., Ltd., Seoul (KR)

(72) Inventor: Binn Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 174 days.

(21) Appl. No.: 13/717,793

(22) Filed: Dec. 18, 2012

(65) Prior Publication Data

US 2013/0335391 A1 Dec. 19, 2013

(30) Foreign Application Priority Data

Jun. 14, 2012 (KR) ..... 10-2012-0063814

(51) Int. Cl.
*G09G 3/32* (2006.01)
*G09G 3/30* (2006.01)

(52) U.S. Cl.
CPC ..... *G09G 3/3291* (2013.01); *G09G 3/3233* (2013.01); *G09G 2300/0819* (2013.01); *G09G 2300/0852* (2013.01); *G09G 2300/0861* (2013.01)
USPC ..... 345/82; 345/76

(58) Field of Classification Search
USPC ..... 345/76–84, 204, 211–213; 315/169.3
See application file for complete search history.

(56) References Cited

U.S. PATENT DOCUMENTS 7,408,533 B2 * 8/2008 Eom et al. ..... 345/76
7,646,366 B2 * 1/2010 Ha et al. ..... 345/82
7,760,171 B2 * 7/2010 Kwon ..... 345/82
7,893,897 B2 * 2/2011 Chung et al. ..... 345/82
7,973,746 B2 * 7/2011 Han et al. ..... 345/78
8,054,250 B2 * 11/2011 Kim ..... 345/76
8,159,423 B2 * 4/2012 Choi ..... 345/76
8,269,703 B2 * 9/2012 Park ..... 345/80
8,284,136 B2 * 10/2012 Kang et al. ..... 345/82
8,305,307 B2 * 11/2012 Ono ..... 345/76
8,345,039 B2 * 1/2013 Choi et al. ..... 345/214
8,400,380 B2 * 3/2013 Lee ..... 345/77
8,462,089 B2 * 6/2013 Han et al. ..... 345/82
8,547,372 B2 * 10/2013 Chung et al. ..... 345/212
8,558,767 B2 * 10/2013 Kwon ..... 345/77
8,593,378 B2 * 11/2013 Ryu et al. ..... 345/77
8,643,575 B2 * 2/2014 Kim ..... 345/82
8,717,259 B2 * 5/2014 Park ..... 345/76
2009/0225013 A1 * 9/2009 Lee et al. ..... 345/80
2011/0025659 A1 * 2/2011 Kwak et al. ..... 345/205
2011/0134100 A1 * 6/2011 Chung et al. ..... 345/212
2012/0019501 A1 * 1/2012 Choi ..... 345/211

* cited by examiner

*Primary Examiner* — Rodney Amadiz

(74) *Attorney, Agent, or Firm* — Morgan, Lewis & Bockius LLP

(57) ABSTRACT

An organic light emitting diode display device may include a first transistor connected between a data line and a first node; a second transistor connected between the first node and a second node; a third transistor connected between a reference voltage line and a third node; a fourth transistor connected between a initialization voltage terminal and the second node; a driving transistor having a source electrode connected to the second node, a gate electrode connected to the third node, and a drain electrode connected to a high electric potential voltage terminal; a first capacitor connected between the first node and the drain or source electrode of the driving transistor; a second capacitor connected between the first node and the third node; and a light emitting diode connected to a low electric potential voltage terminal and to the second node.

15 Claims, 8 Drawing Sheets

ORGANIC LIGHT EMITTING DIODE DISPLAY DEVICE AND METHOD OF DRIVING THE SAME

This application claims the priority benefit of Korean Patent Application No. 10-2012-0063814, filed on Jun. 14, 2012, which is hereby incorporated by reference in its entirety.

BACKGROUND

1. Field of the Disclosure

The present disclosure relates to an organic light emitting diode display device, and more particularly, to an organic light emitting diode display device and a method of driving the same, where the lifetime of the display device may be improved by compensating for degradation and non-uniformity properties of a transistor in the display device.

2. Discussion of the Related Art

FIG. 1 is a schematic drawing illustrating an equivalent circuit of a pixel of an organic light emitting diode display device, and FIG. 2 is a timing chart of the control signals of an organic light emitting diode display device.

As shown in FIG. 1, in the pixel of the ordinary organic light emitting diode display device, first and second transistors (T1 and T2), a driving transistor (Tdr), a light emitting control transistor Tem, first and second capacitors C1 and C2, and an organic light emitting diode (OLED) may be formed. The transistors (T1, T2, Tdr and Tem) may be PMOS type transistors.

The first transistor (T1) has a drain electrode where a data voltage (Vdata) is supplied, a gate electrode where a select signal is supplied, and a source electrode which is connected to the first capacitor (C1).

The second transistor (T2) has a drain electrode which is connected to the second capacitor (C2), a gate electrode where a control signal is supplied, and a source electrode connected to a source electrode of the light emitting control transistor (Tem).

The light emitting control transistor (Tem) has a drain electrode which is connected to a source electrode of the driving transistor (Tdr), a gate electrode where a light emitting control signal is supplied, and a source electrode connected to the organic light emitting diode (OLED).

The light emitting control transistor may sense a threshold voltage of the driving transistor (Tdr) and may prevent the organic light emitting diode (OLED) from emitting light while the data voltage (Vdata) is supplied.

The driving transistor has a drain electrode connected to the second capacitor (C2), a gate electrode connected to the first capacitor (C1), and a source electrode connected to the source electrode of the second transistor (T2).

In other words, in the organic light emitting diode display device of the related art, the gate and drain electrodes of the driving transistor (Tdr) are connected with each other to complete a diode structure.

The driving transistor (Tdr) functions as a current source to let current flow to the organic light emitting diode (OLED), allowing the organic light emitting diode (OLED) to emit light.

The strength of the light emitted from the organic light emitting diode (OLED) is proportional to the amount of current flow through the organic light emitting diode (OLED). The amount of current flow to the organic light emitting diode (OLED) may be proportional to the strength of the data voltage (Vdata) applied to the gate electrode of the driving transistor (Tdr).

Therefore, the organic light emitting diode display device can display images by applying various data voltages (Vdata) to pixels to show different tone wedges.

To drive pixels, there are typically a plurality of control signals such as a control signal (Control), a light emitting control signal (Em), and/or a select signal (Select).

As shown in FIG. 2, the data voltage (Vdata), the control signal (Control), and the select signal (Select) may maintain the voltage level at a low level (Low) for a relatively short time, and for the rest of the time (which is relatively long) the select signal (Select) may maintain the voltage level at a high level (High). This forms a pulse shape.

However, in embodiments where the first and second transistors (T1 and T2), the driving transistor (Tdr), and the light emitting control transistor (Tem) are NMOS-type transistors, the above explanations should be reversed.

For example, in embodiments where the above-noted transistors are NMOS-type transistors, the first and second transistors (T1 and T2) maintain a turn-on state (Turn-On) while a low level select signal (Select) and low level control signal (Control) are respectively applied to these transistors.

Meanwhile, the voltage level of the light emitting control signal (Em) is maintained at a high level (High) for a short time, and maintained at a low level (Low) for a long time. This forms a pulse shape.

In other words, the light emitting control transistor (Tem) maintains a turn-on state for a long time while a low level voltage (Low) is applied via the light emitting control signal (Em).

If the light emitting control transistor (Tem) maintains a turn-on state for a long time, the transistor may become degraded and the quality of the display may worsen.

Also, because the gate and drain electrodes of the driving transistor (Tdr) are connected to each other to form a diode structure, it is impossible to sense a positive threshold voltage.

Accordingly, there occurs a problem that the amount of current flowing through the organic light emitting diode (OLED) varies depending on a deviation of positive threshold voltage.

SUMMARY

Accordingly, embodiments of the present invention are directed to an organic light emitting diode display device that substantially obviates one or more of the problems due to limitations and disadvantages of the related art.

An object of embodiments in accordance with the present invention is to provide an organic light emitting diode display device and the driving method of the same that can compensate current change of the light emitting diode due to the positive or negative deviation of threshold voltage.

Another object of embodiments in accordance with the invention is to provide an organic light emitting diode display device and the driving method of the same that can reduce worsening of display quality owing to the driving voltage loss and degradation of the light emitting control transistor, by eliminating the light emitting control transistor for sensing the threshold voltage.

Additional features and advantages of embodiments in accordance with the invention will be set forth in the description which follows, and in part will be apparent from the description, or may be learned by practice of embodiments of the invention. The objectives and other advantages of embodiments of the invention will be realized and attained by the structure particularly pointed out in the written description and claims hereof as well as the appended drawings.

In one embodiment, an organic light emitting diode display device includes a first transistor connected between a data line and a first node; a second transistor connected between the first node and a second node; a third transistor connected between a reference voltage line and a third node; a fourth transistor connected between a initialization voltage terminal and the second node; a driving transistor having a source electrode connected to the second node, a gate electrode connected to the third node, and a drain electrode connected to a high electric potential voltage terminal; a first capacitor connected between the first node and the drain or source electrode of the driving transistor; a second capacitor connected between the first node and the third node; and a light emitting diode connected to a low electric potential voltage terminal and to the second node.

In another aspect, a method of driving an organic light emitting diode display device including first, second, third and fourth transistors, a driving transistor, first and second capacitors, and an organic light emitting diode, includes applying an initialization voltage to a first node connected to the second capacitor and a second node connected to the driving transistor, and applying a reference voltage to a third node connected to a gate electrode of the driving transistor, while the first, second and fourth transistors are turned on; applying a threshold voltage of the driving transistor to the second capacitor, while the second and third transistors are turned on; and applying a data voltage to the first node for the organic light emitting diode to emit light, while the first transistor is turned on.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain principles of embodiments of the invention.

DETAILED DESCRIPTION OF THE ILLUSTRATED EMBODIMENTS

Reference will now be made in detail to embodiments of the present invention, examples of which are illustrated in the accompanying drawings.

Figure 1:
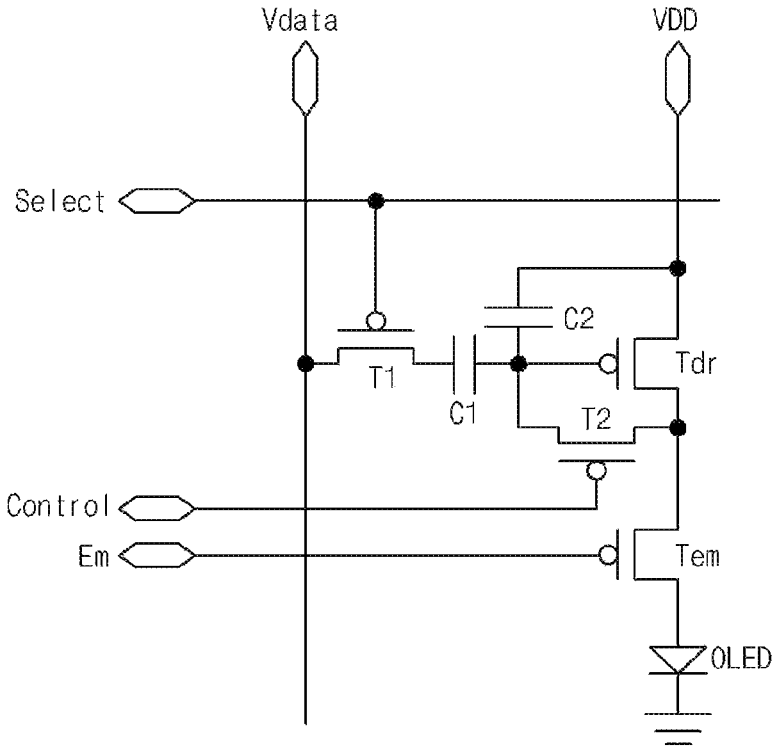
FIG. 1 Related Art
FIG. 1 is a drawing showing an equivalent circuit of a pixel of a general organic light emitting diode display device.
Figure 2:
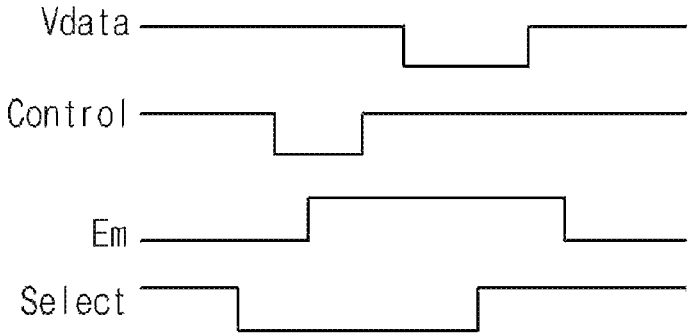
FIG. 2 is a timing chart of control signals supplied to a general organic light emitting diode display device.
Figure 3:
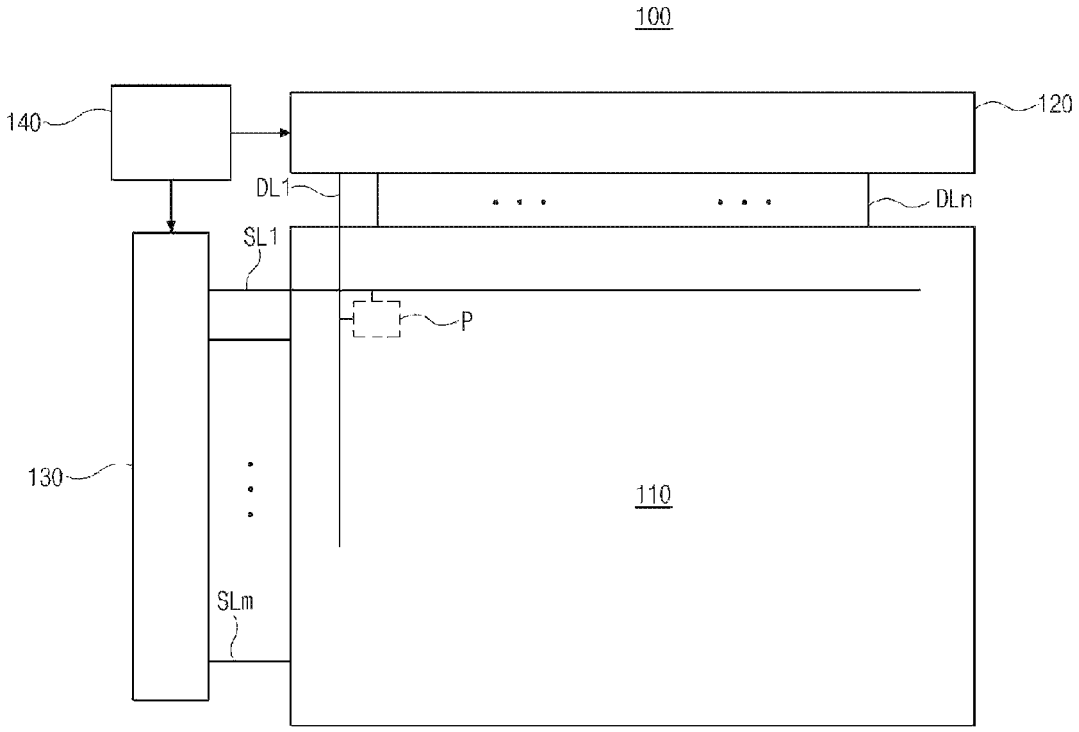
FIG. 3 is a schematic view of an organic light emitting diode display device according to an embodiment of the present invention.
Figure 4:
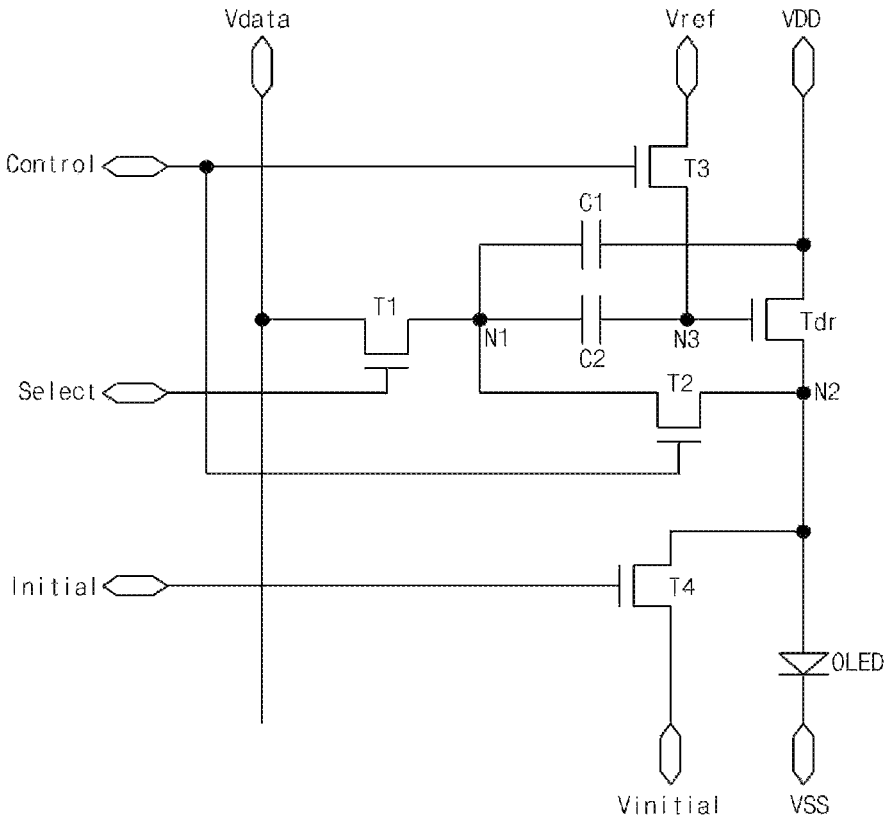
FIG. 4 is a schematic view of an equivalent circuit of a pixel of an organic light emitting diode display device according to a first embodiment of the present invention.

FIG. 3 is a schematic view of an organic light emitting diode display device according to an exemplary embodiment of the present invention, and FIG. 4 is a schematic view of an equivalent circuit of a pixel of an organic light emitting diode display device according to a first embodiment of the present invention.

As shown in FIG. 3, an organic light emitting diode display device 100 according to an exemplary embodiment of the invention may include a display panel 110 for displaying images, a source driver 120, a scan driver 130, and a timing controller for controlling driving timing of the source driver 120 and the scan driver 130.

The display panel 110 may include a plurality of scan lines (SL1 to SLm) and a plurality of data lines (DL1 to DLn) which define a plurality of pixels (P) by crossing each other. Because each pixel may have the same structure, the embodiment is herein explained by using a scan line (SL) and a data line (DL) for convenience.

The source driver 120 may have at least one driver IC (not shown) for supplying data voltage to the display panel 110.

The source driver 120 may generate data voltage by using an image signal (R/G/B) transmitted from the timing controller 140 and a plurality of data control signals, and may supply the data voltage to the display panel 110 through the data line (DL).

The timing controller 140 may receive a plurality of image signals, vertical sync signals (Vsync), horizontal sync signals, and data enable signals from the system (System), such as a graphics card, through an interface. The timing controller 140 may generate a plurality of data voltages to be provided to each driver IC of the source driver 120.

The scan driver 130 may generate select signals by using a control signal transmitted from the timing controller 140 and controls to provide the generated select signals to the display panel 110 through the scan line (SL).

Meanwhile, each pixel (P) may have first to fourth transistors (T1, T2, T3, and T4), a driving transistor (Tdr), first and second capacitors (C1 and C2), and a organic light emitting diode (OLED). The first to fourth transistors (T1, T2, T3, and T4) and the driving transistor (Tdr) may be NMOS type transistors, as shown in FIG. 4.

A data voltage (Vdata) and a select signal (Select) may be provided to the drain and gate electrodes of the first transistor (T1), respectively, and the source electrode of the first transistor (T1) may be connected to a first node (N1) of the second capacitor (C2). The first transistor (T1) may turn on (Turn-On) according to the select signal (Select) transmitted through the scan line (SL), and may thereby provide the data voltage (Vdata) to the first node (N1).

The drain electrode of the second transistor (T2) may be connected to the first node (N1), and the source electrode of the second transistor (T2) may be connected to a second node (N2) and/or the source electrode of the driving transistor (Tdr). A control signal (Control) may be provided to the gate electrode of the second transistor (T2). The second transistor (T2) may turn on/off according to the control signal (Control) provided through a control line (not shown).

A reference voltage (Vref) and a control signal (Control) may be provided to the third transistor (T3) through its drain and gate electrodes, respectively. The source electrode of the third transistor (T3) may be connected to a third node (N3) and/or the gate electrode of the driving transistor (Tdr). The third transistor (T3) may turn on according to the control signal (Control) provided through a control line (not shown) and may initialize the third node (N3) to a reference voltage (Vref). The reference voltage (Vref) may, for example, be from −1V to 5V.

An initialization signal (Initial) and an initialization voltage (Vinitial) may be provided to the fourth transistor (T4) through its gate and drain electrodes, respectively. The source electrode of the transistor (T4) may be connected to an anode electrode of the organic light emitting diode (OLED). The fourth transistor (T4) may turn on according to the initialization signal (Initial) provided through an initialization line (not shown), and may initialize the second and third nodes (N2 and N3) and the anode electrode of the organic light emitting diode (OLED) to a voltage lower than the threshold voltage of the organic light emitting diode (OLED). The initialization voltage (Vinitial) may be, for example, from −5V to 0V.

Therefore, the amount of current flowing through the organic light emitting diode (OLED) may become smaller and the organic light emitting diode (OLED) may not emit light.

The first capacitor (C1) may be connected between the drain electrode of the driving transistor (Tdr) and the first node (N1), and the second capacitor (C2) may be connected between the third node (N3) and the first node (N1).

The first capacitor (C1) may maintain the data voltage for one frame and may maintain a constant current flowing through the organic light emitting diode (OLED). In other words, the first capacitor (C1) may be a storage capacitor for maintaining a constant tone wedge.

The second capacitor (C2) may be a sensing capacitor for sensing the threshold voltage of the driving transistor (Tdr).

With regard to the driving transistor (Tdr), a high electric potential voltage (VDD) may be supplied to its drain electrode, and the gate and source electrodes may be connected to the third node (N3) and the second node (N2), respectively. The high electric potential voltage (VDD) may be, for example, from 10V to 15V.

The driving transistor (Tdr) of the pixel in an exemplary embodiment of the invention may adopt a source follower structure. In other words, the voltage of the gate electrode is maintained constant and the source electrode state becomes floating such that it can sense the threshold voltage. Thus, the organic light emitting diode display device 100 can compensate for deviation of the threshold voltage regardless of whether the threshold voltage is positive or negative.

In other words, the organic light emitting diode display device 100 according to embodiments of the invention may compensate a change of current of the light emitting diode according to the deviation of positive or negative threshold voltage and may maintain the amount of current through the light emitting diode as constant, regardless of deviation of threshold voltage.

The driving transistor (Tdr) may control the amount of current flowing through the organic light emitting diode (OLED) proportional to the magnitude of data voltage applied to the gate electrode of the driving transistor (Tdr). In other words, the organic light emitting diode display device can display images by displaying different tone wedges by applying various data voltage to each pixel (P).

As noted above, the anode electrode of the organic light emitting diode (OLED) may be connected to a source electrode of the fourth transistor (T4). Meanwhile, a low electric potential voltage (VSS) can be applied to the cathode electrode. The low electric potential voltage can be 0V, for example.

Hereinafter, operation of a pixel of the organic light emitting diode display device will be explained.

Figure 5:
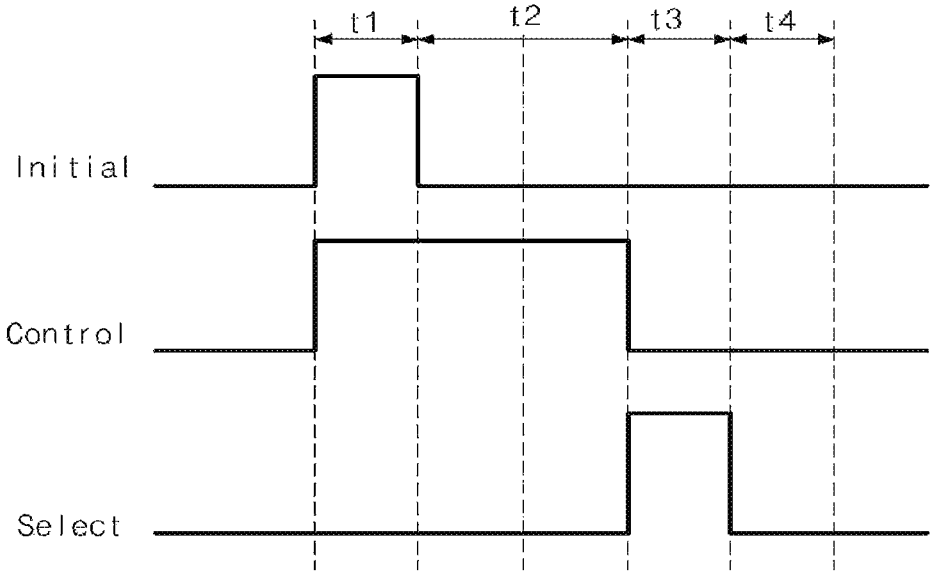
FIG. 5 is a timing chart of control signals supplied to the organic light emitting diode display device according to a first embodiment of the present invention.

FIG. 5 is a timing chart illustrating a plurality of control signals that may be supplied to the organic light emitting diode display device, and FIGS. 6*a* to 6*d* illustrate exemplary operation processes of the organic light emitting diode display device according to the first embodiment of the invention as exemplarily shown in FIG. 4.

As shown in FIG. 5, for an initialization time (t1), a high level initialization signal (Initial) and control signal (Control) may be applied, and a low level select signal (Select) may be applied.

Figure 6A:
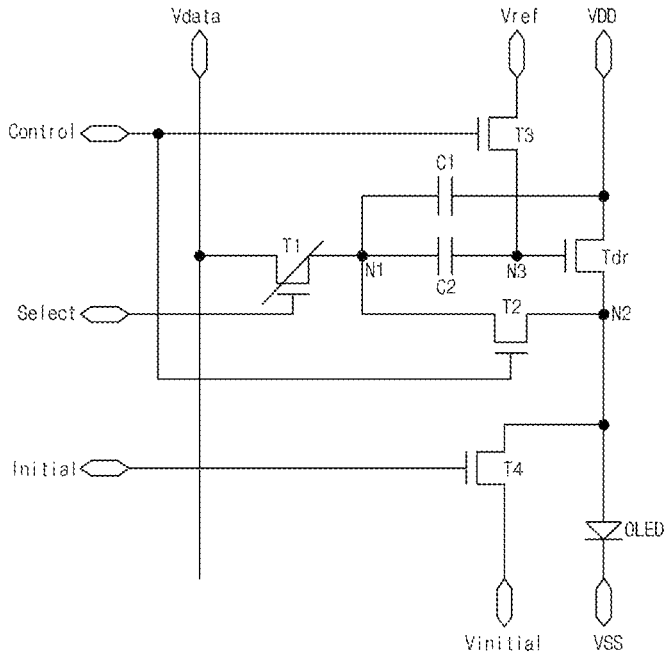
FIGS. 6*a* to 6*d* are drawings for explaining a driving process of the organic light emitting diode display device according to a first embodiment of the present invention.

As a result, as shown in FIG. 6*a*, the second, third, and fourth transistors (T2, T3, and T4) may be turned on by the high level initialization signal (Initial) and the control signal (Control). The first transistor (T1) may be turned off.

For the initialization time (t1), the third node (N3) may be initialized to have a reference voltage (Vref), and the first and second nodes (N1 and N2) may be initialized to have a initialization voltage (Vinitial). For example, the reference voltage can be −1V.

For example, for the initialization time (t1), a first current path may be formed between the third node (N3) and the reference voltage line, and the third node (N3) may be initialized to have the reference voltage (Vref).

A second current path may be formed from the first node (N1) connected to the second node (N2) via the second transistor (T2); thus, the first node (N1) may also be initialized to have the initialization voltage (Vinitial).

At this time, the initialization voltage may be lower than sum of the threshold voltage 'Vth_oled' of the organic light emitting diode (OLED) and the electric potential 'VSS' of the organic light emitting diode (OLED) (i.e., Vinitial<Vth_oled+VSS).

In other words, according to the first embodiment of the invention, for the initialization time (t1), a reference voltage (Vref) may be applied to the third node (N3), and the first and second nodes (N1 and N2) may be initialized to have the initialization voltage (Vinitial). Because the second node (N2) is initialized to have the initialization voltage (Vinitial) for the initialization time (t1), the organic light emitting diode (OLED) may be prevented from emitting light (i.e., it may be turned off).

Referring back to FIG. 5, for the sensing time (t2), a high level control signal (Control) may be applied, and a low level initialization signal (Initial) and select signal (Select) may be applied.

Figure 6B:
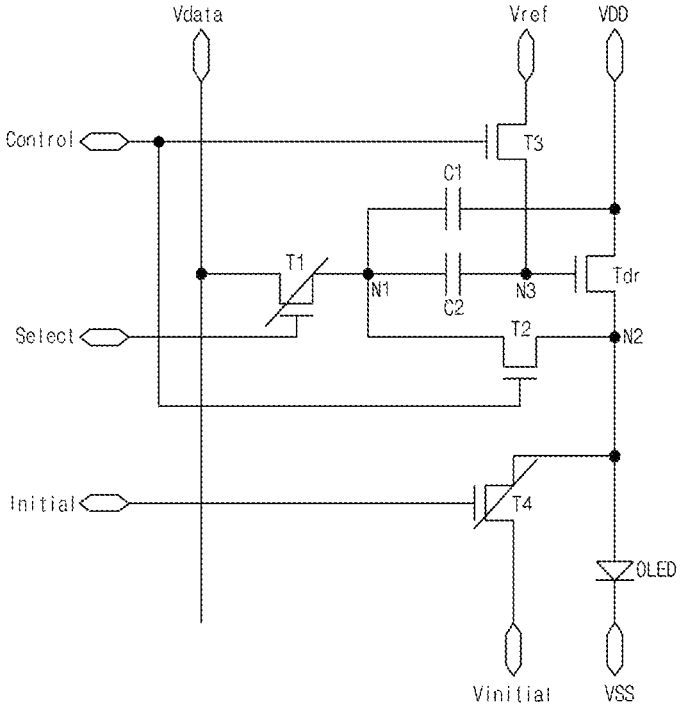

As a result, as shown in FIG. 6*b*, the second and third transistors (T2 and T3) may be maintained in a turn-on state by the high level control signal (Control).

Meanwhile, the first and fourth transistors (T1 and T4) may be turned off.

For the sensing time (t2), the voltage of the third node (N3) may be maintained at the reference voltage (Vref), and the voltage of the first and second nodes (N1 and N2) may be reduced from the reference voltage (Vref) by the threshold voltage (Vth) to be 'Vref−Vth'.

For example, for the sensing time (t2), the reference voltage (Vref) may be applied to the third node (N3), and the states of the first and second nodes (N1 and N2) become floating. At this time, the second capacitor (C2) may store the threshold voltage (Vth) of the driving transistor (Tdr), and thus, the first and second nodes (N1 and N2) may have a voltage of 'Vref−Vth', which is the voltage drop at the third node (N3) by the threshold voltage (Vth) of the driving transistor (Tdr).

The voltage 'Vref−Vth' of the first and second nodes (N1 and N2) may be lower than the sum of the threshold voltage (Vth_oled) of the organic light emitting diode (OLED) and the electric potential (VSS) of the cathode electrode of the organic light emitting diode (OLED). (Vref−Vth<Vth-oled+VSS).

Referring back to FIG. 5, for a data writing time (t3), a high level select signal (Select) may be applied, and a low level initialization signal (Initial) and control signal (Control) may be applied.

Figure 6C:
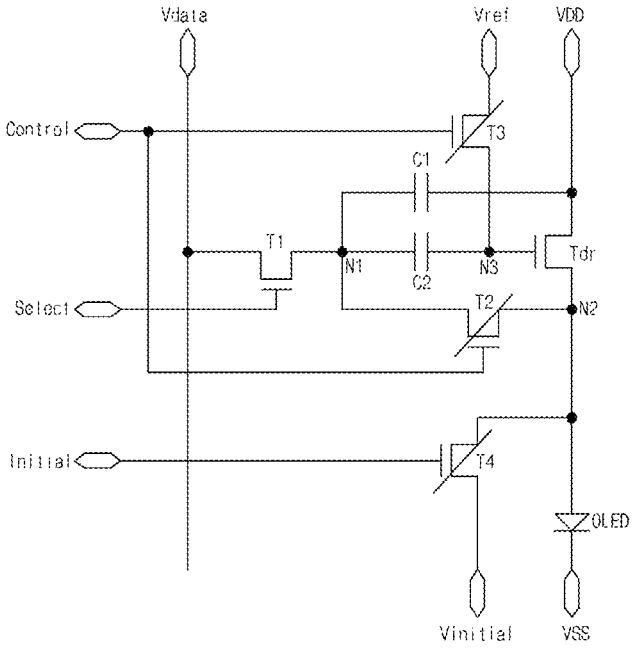

As a result, as shown in FIG. 6*c*, the first transistor (T1) may be turned on by the high level select signal (Select). The second, third, and fourth transistors (T2, T3, and T4) may be turned off.

For the data writing time (t3), a data voltage (Vdata) may be provided to the first node (N1), and the voltage may be increased by the threshold voltage (Vth) of the driving transistor (Tdr) at the first node (N1). In other words, a voltage 'Vdata+Vth' may be applied to the third node (N3).

For the data writing time (t3), the amount of current flowing through the driving transistor (Tdr) may continue to increase. As the amount of the current increases, voltage 'Vth_oled+VSS' can be applied to the second node (N2).

When the voltage of the second node (N2) becomes 'Vth_oled+VSS', the current may flow through the organic light emitting diode (OLED) to cause the organic light emitting diode to emit light.

Figure 6D:
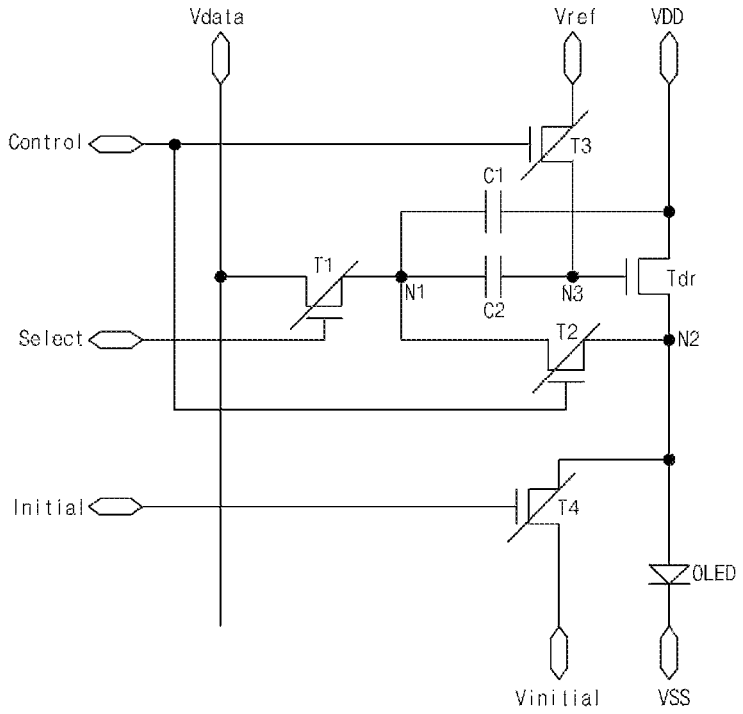

Referring back to FIG. 5, for the light emitting time (t4), the initialization signal (Initial), the control signal (Control), and the select signal (Select) may all be at a low level. As a result, as shown in FIG. 6*d*, the first, second, third, and the fourth transistors (T1, T2, T3, and T4) may be turned off.

For the light emitting time (t4), the data voltage (Vdata) may be applied to the first node (N1) and maintained. The voltage of the third node (N3) keeps 'Vdata+Vth'. And the voltage of the second node (N2) may be kept at 'Vth_oled+VSS', which makes the organic light emitting diode (OLED) maintain light emittance.

At this time, the current ($I_{OLED}$) of the light emitting diode flowing through the organic light emitting diode (OLED) may be as follows:

$$\begin{aligned} I_{OLED} &= K \times (Vgs - Vth)^2 \\ &= K \times (Vdata + Vth - (\text{Vth_oled} + VSS) - Vth)^2 \\ &= K \times (Vdata - \text{Vth_oled} - VSS)^2 \end{aligned}$$

Wherein K is a proportional constant which is determined by the structure of the driving transistor (Tdr) and its physical characteristics. Mobility and width-length ratio (W/L) of the channel of the driving transistor (Tdr) may be considered.

Consequently, for the light emitting time (t4), current ($I_{OLED}$) may be unrelated to the threshold voltage (Vth) of the driving transistor (Tdr), but may be related to the data voltage (Vdata) and low electric potential voltage (VSS).

Therefore, the non-uniformity of brightness owing to the differences in characteristics of the transistors may be be improved.

Figure 7:
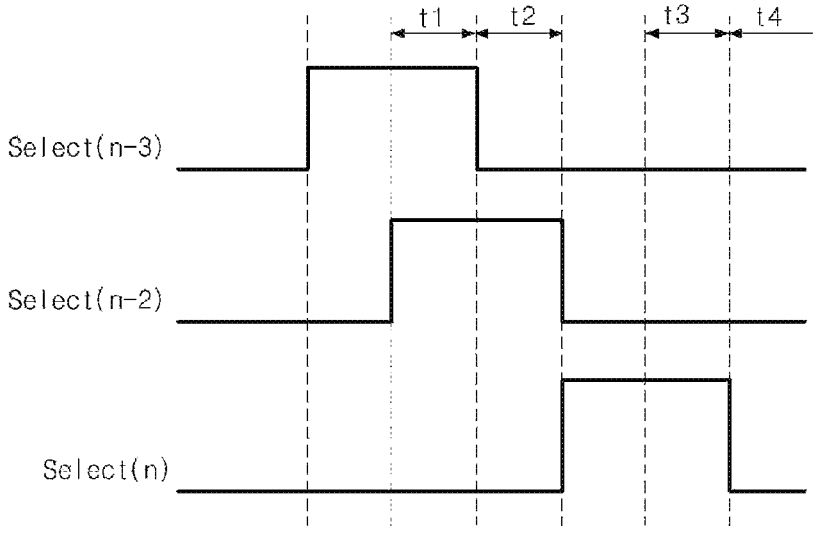
FIG. 7 is a timing chart of control signals supplied to the organic light emitting diode display device according to a second embodiment of the present invention.

FIG. 7 is a timing chart of control signals that may be supplied to the organic light emitting diode display device according to a second embodiment of the invention. The initialization signal (Initial of FIG. 5), the control signal (Control of FIG. 5), and the select signal (Select(n−3)) may be supplied through the same driver IC.

As shown in FIG. 7, the initialization signal (Initial of FIG. 5) and the control signal (Control of FIG. 5) may be replaced by the N−3th select signal (Select(n−3)) and the N−2th select signal (Select(n−2)), respectively. In terms of timing, the N−3th select signal (Select(n−3)) may be the third signal before the Nth select signal (Select(n)), and the N−2th select signal (Select(n−2)) may be the second signal before the Nth select signal (Select(n)).

The Nth select signal (Select(n)), the N−2th select signal (Select(n−2)), and the N−3th select signal (Select(n−3)) may maintain a high level voltage longer than one horizontal period by controlling the pulse width. Also, the N−2th select signal (Select(n−2)) and the N−3th select signal (Select(n−3)) may overlap each other for one horizontal period.

Therefore, for the initialization time (t1), the N−2th select signal (Select(n−2)) and the N−3th select signal (Select(n−3)) may be at a high level, and the Nth select signal (Select(n)) may be at a low level.

For the sensing time (t2), the N−2th select signal (Select (n−2)) may be at a high level, and the N−3th select signal (Select(n−3)) and the Nth select signal (Select(n)) may be at a low level.

For the data writing time (t3), the Nth select signal (Select (n)) may be at a high level, and the N−2th select signal (Select(n−2)) and the N−3th select signal (Select(n−3)) may be at a low level.

For the light emitting time (t4), the Nth select signal (Select (n)), the N−2th select signal (Select(n−2)), and the N−3th select signal (Select(n−3)) may be at a low level.

As explained above, according to the second embodiment of the invention, the initialization signal (Initial of FIG. 5), the control signal (Control of FIG. 5), and the select signal (Select (n−3)) may be supplied through one driver IC, resulting in reducing the number of drive ICs.

Figure 8:
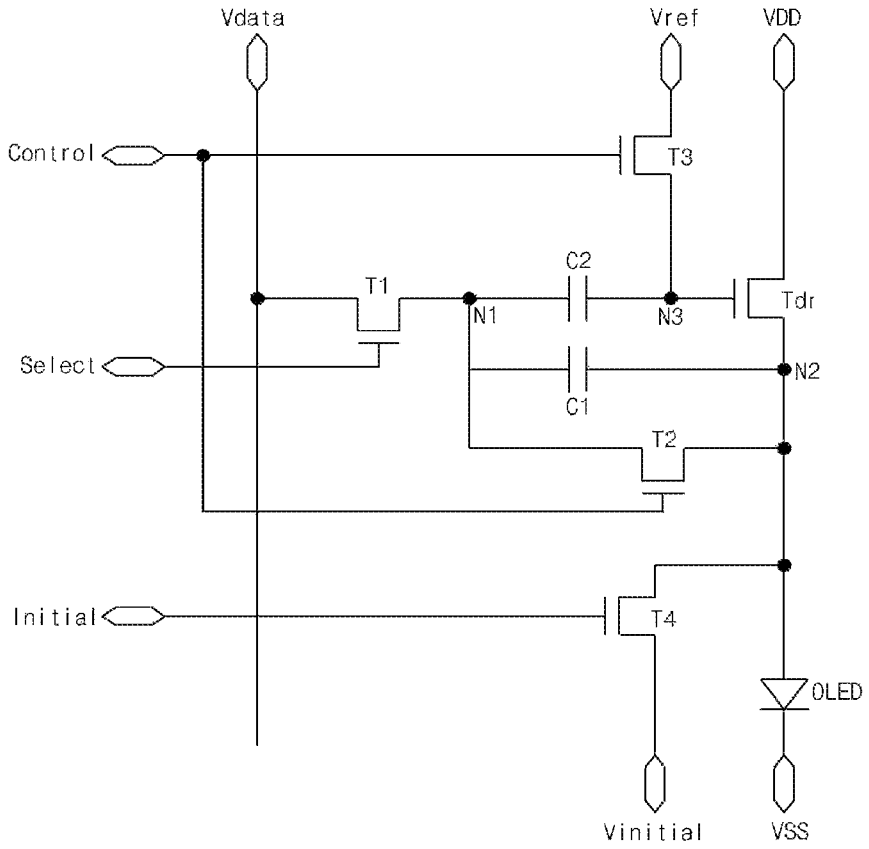
FIG. 8 is a schematic view of an equivalent circuit of pixel of an organic light emitting diode display device according to a third embodiment of the present invention.

FIG. 8 is a schematic view of an exemplary equivalent circuit of a pixel of the organic light emitting diode display device. Each pixel (P) may have first, second, third, and fourth transistors (T1, T2, T3, and T4), a driving transistor (Tdr), first and second capacitors (C1 and C2), and an organic light emitting diode (OLED).

At this time, the first, second, third and fourth transistors (T1, T2, T3, and T4) and the driving transistor (Tdr) may be NMOS type transistors, as shown in FIG. 8.

The organic light emitting diode display device according to a third embodiment of the invention as discussed below may be similar to that of the second embodiment. Thus, the below discussion focuses primarily on possible differences between these embodiments.

In the third embodiment, the first capacitor (C1) may be a storage capacitor which maintains data voltage for one frame in order to make an amount of current flowing through the organic light emitting diode (OLED) constant, thereby resulting in maintaining a tone wedge of the organic light emitting diode (OLED).

The first capacitor (C1) may be connected between the first node (N1) of the second capacitor (C2) and the second node (N2) and/or source electrode of the driving transistor (Tdr).

Figure 9:
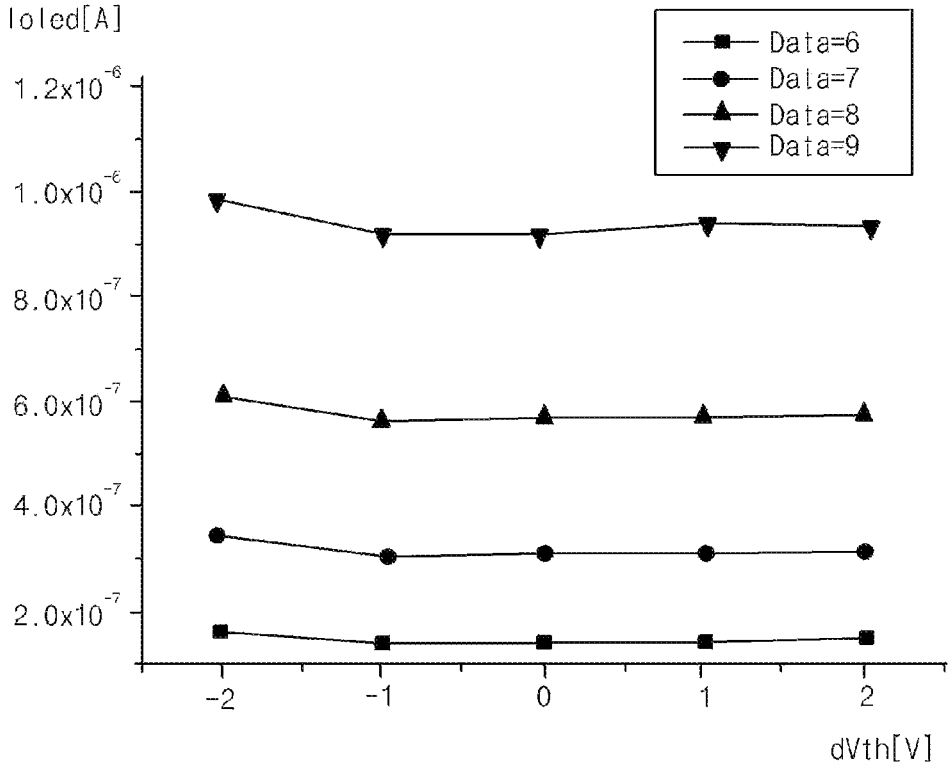
FIG. 9 is a drawing for explaining current change of the light emitting diode depending on a deviation of threshold voltage of the organic light emitting diode display device according to an embodiment of the present invention.

FIG. 9 is a graph for explaining current change of the light emitting diode according to the deviation of the threshold voltage of the organic light emitting diode display device according to the third embodiment in accordance with the invention.

As shown in FIG. 9, the deviation of the threshold voltage (dVth) can be positive or negative, but the current ($I_{OLED}$) of the light emitting diode may be maintained almost constant regardless of the deviation of the threshold voltage (dVth).

The current ($I_{OLED}$) of the light emitting diode may be maintained almost constant even though the data voltage (Data) may change.

Because the organic light emitting diode display device according to embodiments in accordance with the invention may adopt a source follower structure, compensation of the current of the light emitting diode according to the positive or negative deviation of the threshold voltage can be accomplished.

And because it is not necessary to have a light emitting control transistor for sensing the threshold voltage, the driving voltage loss by the light emitting control transistor and degradation of the light emitting control transistor can be prevented, and consequently the worsening of the display quality can be prevented.

It will be apparent to those skilled in the art that various modifications and variations can be made in the embodiments of the present invention without departing from the spirit or scope of embodiments of the invention. Thus, it is intended that the embodiments of the present invention cover the modifications and variations of this invention provided they come within the scope of the appended claims and their equivalents.

What is claimed is:

1. An organic light emitting diode display device, comprising:

a first transistor connected between a data line and a first node;

a second transistor connected between the first node and a second node;

a third transistor connected between a reference voltage line and a third node;

a fourth transistor connected between an initialization voltage terminal and the second node;

a driving transistor having a source electrode connected to the second node, a gate electrode connected to the third node, and a drain electrode connected to a high electric potential voltage terminal;

a first capacitor connected between the first node and the drain or source electrode of the driving transistor;

a second capacitor connected between the first node and the third node; and a light emitting diode connected to a low electric potential voltage terminal and to the second node.

2. The organic light emitting diode display device of claim 1, wherein the first capacitor maintains a data voltage transmitted from the data line for one frame whereby a constant current flows through the light emitting diode.

3. The organic light emitting diode display device of claim 1, wherein the first capacitor is connected between the first node and the drain electrode of the driving transistor.

4. The organic light emitting diode display device of claim 1, wherein the first capacitor is connected between the first node and the source electrode of the driving transistor.

5. The organic light emitting diode display device of claim 1, wherein the display device provides a reference voltage through the reference voltage line and a control signal through a control line to the drain and gate electrode of the third transistor, respectively.

6. The organic light emitting diode display device of claim 1, wherein the display device provides an initialization signal through an initialization line and an initialization voltage through the initialization voltage terminal to the gate and drain electrode of the fourth transistor, respectively.

7. The organic light emitting diode display device of claim 1, wherein the display device includes a plurality of scan lines, one of the plurality of scan lines being connected to the gate of the first transistor, and a select signal through the one of the plurality of scan lines being provided to the gate of the first transistor.

8. The organic light emitting diode display device of claim 1, wherein the display device provides an initialization signal through the initialization voltage terminal, a control signal through a control line, and a select signal through a scan line, by a same driver integrated circuit (IC).

9. A method of driving an organic light emitting diode display device including first, second, third and fourth transistors, a driving transistor, first and second capacitors, and an organic light emitting diode (OLED), comprising:

applying an initialization voltage to a first node connected to the second capacitor and a second node connected to the driving transistor, and applying a reference voltage to a third node connected to a gate electrode of the driving transistor, while the first, second and fourth transistors are turned on;

applying a threshold voltage of the driving transistor to the second capacitor, while the second and third transistors are turned on; and applying a data voltage to the first node for the organic light emitting diode to emit light, while the first transistor is turned on.

10. The method of claim 9, further comprising maintaining the data voltage at the first node, while the first, second, third, and forth transistors are turned off.

11. The method of claim 9, wherein during the applying the initialization voltage and the applying the reference voltage, the OLED is prevented from emitting light.

12. The method of claim 9, wherein during the applying the threshold voltage, the second capacitor stores the threshold voltage.

13. The method of claim 9, wherein during the applying the data voltage, the OLED begins emitting light.

14. The method of claim 10, wherein during the maintaining the data voltage, current flows through the OLED so that the OLED emits light, an amount of the current flowing through the OLED being related to the data voltage but being unrelated to the threshold voltage.

15. The method of claim 9, wherein the organic light emitting diode display device includes:

the first transistor connected between a data line and the first node;

the second transistor connected between the first node and the second node;

the third transistor connected between a reference voltage line and the third node;

the fourth transistor connected between an initialization voltage terminal and the second node;

the driving transistor having a source electrode connected to the second node, the gate electrode connected to the third node, and a drain electrode connected to a high electric potential voltage terminal;

the first capacitor connected between the first node and the drain or source electrode of the driving transistor;

the second capacitor connected between the first node and the third node; and the OLED connected to a low electric potential voltage terminal and to the second node.

* * * * *